US010842260B2

(12) United States Patent
Leng

(10) Patent No.: US 10,842,260 B2
(45) Date of Patent: Nov. 24, 2020

(54) COMPOSITE TABLE TOP

(71) Applicant: NEW-TEC INTEGRATION (XIAMEN) CO., LTD., Fujian (CN)

(72) Inventor: Luhao Leng, Fujian (CN)

(73) Assignee: NEW-TEC INTEGRATION (XIAMEN) CO., LTD., Fujian (CN)

( * ) Notice: Subject to any disclaimer, the term of this patent is extended or adjusted under 35 U.S.C. 154(b) by 0 days.

(21) Appl. No.: 16/534,988

(22) Filed: Aug. 7, 2019

(65) Prior Publication Data

US 2020/0022490 A1 Jan. 23, 2020

Related U.S. Application Data

(63) Continuation of application No. 16/277,868, filed on Feb. 15, 2019, now abandoned, which is a continuation of application No. 15/842,461, filed on Dec. 14, 2017, now Pat. No. 10,206,497, which is a continuation of application No. 15/667,525, filed on Aug. 2, 2017, now Pat. No. 9,867,458, which is a continuation of application No. 14/049,582, filed on Oct. 9, 2013, now Pat. No. 9,808,081, which is a continuation-in-part of application No. 13/192,849, filed on Jul. 28, 2011, now abandoned.

(51) Int. Cl.
*A47B 13/00* (2006.01)
*A47B 13/08* (2006.01)

(52) U.S. Cl.
CPC ..... *A47B 13/08* (2013.01); *A47B 13/083* (2013.01); *Y10T 428/24612* (2015.01)

(58) Field of Classification Search
CPC ..... A47B 3/087; A47B 3/0911; A47B 3/0912; A47B 13/003; A47B 13/08; A47B 13/083; A47B 13/086; A47B 13/088; A47B 13/10; E04C 2/388
See application file for complete search history.

(56) References Cited

U.S. PATENT DOCUMENTS

| | | | |
|---|---|---|---|
| 1,979,309 | A | 11/1934 | Beiger |
| 2,739,640 | A | 3/1956 | Brinker et al. |
| 3,439,634 | A | 4/1969 | Bender |
| 3,676,279 | A | 7/1972 | Beaver |
| 5,271,338 | A | 12/1993 | Bonham et al. |
| 5,303,824 | A | 4/1994 | Kohn |
| 5,335,605 | A | 8/1994 | Drabczyk |

(Continued)

FOREIGN PATENT DOCUMENTS

| | | | |
|---|---|---|---|
| CN | 2517302 | Y | 10/2002 |
| CN | 201299266 | Y | 9/2009 |

(Continued)

OTHER PUBLICATIONS

CNIPA, International Search Report for PCT/CN2016/098798. dated Oct. 28, 2016. 4 pages.

*Primary Examiner* — Gisele D Ford
(74) *Attorney, Agent, or Firm* — Perkins Coie LLP; Kenneth H. Ohriner

(57) ABSTRACT

A composite table top including a top plate having an outer and an inner surface, a bottom plate comprising a plurality of projections, each of the plurality of projections having a top defining a top surface. The composite table top has at least a pair of reinforcement inserts disposed at two opposite edges of the bottom plate. The sum of the top surfaces of the plurality of projections is 30%-70% of the upper surface of the bottom plate.

4 Claims, 8 Drawing Sheets

(56) References Cited

U.S. PATENT DOCUMENTS

| | | | |
|---|---|---|---|
| 5,357,872 | A | 10/1994 | Wilmore |
| 5,497,597 | A | 3/1996 | Elzenbeck |
| 5,606,755 | A | 3/1997 | Romein |
| 5,694,865 | A | 12/1997 | Raab |
| 5,732,637 | A | 3/1998 | Raab |
| 5,752,091 | A | 5/1998 | Kai et al. |
| 5,835,661 | A | 11/1998 | Tai et al. |
| 5,868,081 | A | 2/1999 | Raab |
| 5,947,037 | A | 9/1999 | Hornberger et al. |
| 6,058,853 | A | 5/2000 | Pinch |
| 6,058,854 | A | 5/2000 | Tarnay et al. |
| 6,371,034 | B1 | 4/2002 | Simpson et al. |
| 6,666,152 | B2 | 12/2003 | Tsai |
| 6,752,091 | B2 | 6/2004 | Glover et al. |
| 6,817,662 | B2 | 11/2004 | Winter et al. |
| 7,140,308 | B2 | 11/2006 | Tsai |
| 7,735,915 | B2 | 6/2010 | Nye et al. |
| D668,483 | S | 10/2012 | Bennett |
| 8,387,544 | B1 | 3/2013 | Lee |
| 9,504,314 | B2 | 11/2016 | Leng et al. |
| 9,808,081 | B2 | 11/2017 | Leng |
| 9,867,458 | B2 | 1/2018 | Leng |
| 10,206,497 | B2 | 2/2019 | Leng |
| 2003/0183135 | A1 | 10/2003 | Tsai |
| 2003/0200904 | A1 | 10/2003 | Strong |
| 2003/0213414 | A1 | 11/2003 | Strong |
| 2003/0213416 | A1 | 11/2003 | Strong et al. |
| 2004/0187744 | A1 | 9/2004 | Wang |
| 2005/0274306 | A1 | 12/2005 | Strong |
| 2008/0092788 | A1 | 4/2008 | Leng |
| 2008/0098936 | A1 | 5/2008 | Strong |
| 2008/0264307 | A1 | 10/2008 | Vannimwegen et al. |
| 2008/0265307 | A1 | 10/2008 | Lee |
| 2009/0324872 | A1 | 12/2009 | Leng |
| 2010/0043681 | A1 | 2/2010 | Leng |
| 2010/0112265 | A1 | 5/2010 | Leng |
| 2011/0174197 | A1 | 7/2011 | Seger |
| 2011/0203493 | A1 | 8/2011 | Ashby et al. |
| 2013/0025508 | A1 | 1/2013 | Leng |
| 2019/0021484 | A1 | 1/2019 | Leng |

FOREIGN PATENT DOCUMENTS

| | | | |
|---|---|---|---|
| CN | 103239011 | A | 8/2013 |
| CN | 103284471 | A | 9/2013 |
| CN | 205093820 | U | 3/2016 |

COMPOSITE TABLE TOP

CROSS-REFERENCE TO RELATED APPLICATION(S)

This application is a continuation of U.S. patent application Ser. No. 16/277,868, filed Feb. 15, 2019 and now pending, which is a continuation of U.S. patent application Ser. No. 15/842,461, filed Dec. 14, 2017, now U.S. Pat. No. 10,206,497, which is a continuation of U.S. patent application Ser. No. 15/667,525, filed Aug. 2, 2017, now U.S. Pat. No. 9,867,458, which is a continuation of U.S. patent application Ser. No. 14/049,582, filed Oct. 9, 2013, now U.S. Pat. No. 9,808,081, which is a continuation-in-part of U.S. patent application Ser. No. 13/192,849, filed on Jul. 28, 2011 and now abandoned. The above-listed applications are incorporated herein by reference.

TECHNICAL FIELD

The present invention relates to a table, more particularly to a composite table top.

BACKGROUND

The table is one of the most ubiquitous furniture pieces. The prior art table top panel is traditionally made of wood. The use of wood has disadvantages: firstly, consumption of large amount of wood is not environmentally friendly; secondly, wood needs constant maintenance and thirdly, wood may not be used in some applications. Wood substitutes such as fiberboard or flake board may also share similar defects.

To meet the needs of a modern household, a table top panel needs to be tough, durable, lightweight and appealing. As consumers look for more environment friendly alternatives, there are more and more examples of table top panels made of synthetic materials.

Blow molding has been used for manufacture synthetic table top. Blow molding is a manufacturing process by which hollow plastic parts are formed. The blow molding process begins with melting down the plastic and forming the plastic into a parison or preform. The parison is a tube-like piece of plastic with a hole in one end through which compressed air can pass. For table top, a large molding blow molding machine may be needed. In order to provide the required strength, the table top also needs sufficient thickness, resulting in the material overuse and heavy weight.

Therefore, there is a need for an improved table top made of a synthetic material with better applicability, low maintenance cost and better mechanical properties.

SUMMARY

In accordance with one embodiment of the present invention, there is provided a composite table top. The table top comprises a top plate having an outer and an inner surface; a bottom plate comprising a plurality of projections, each of the plurality of projections having a top defining a top surface; and a pair of reinforcement inserts disposed at two opposite edges of the bottom plate. A sum of the top surfaces of the plurality of projections is 30%-70% of the upper surface of the bottom plate.

Preferably, the top surface has a size of 1 to 15 $cm^2$.

Preferably, the sum of the top surfaces of the projections is 40%-60% of the upper surface of the reinforcement plate.

Preferably, the top surface has a size of 3 to 9 $cm^2$.

Preferably, the bottom plate is produced through a vacuum forming process.

Preferably, the top plate has a downward flange, wherein the bottom plate has an upward flange and overlaps with the downward flange.

Preferably, the reinforcement inserts are located besides the upward flange and the downward flange.

Preferably, the reinforcement insert has an L-shaped cross-section, and covers a periphery of the bottom plate and the downward flange of the top plate.

Preferably, the projections have a trapezoidal prism form.

Preferably, the projections have a cylindrical form.

Preferably, the projections have a conical form.

Preferably, the projections have a isosceles trapezoidal prism form.

Preferably, the composite table top further comprises a second pair of reinforcement inserts.

Preferably, the reinforcement inserts form a unitary frame.

Preferably, the downward flange of the top plate and the upward flange of the bottom plate form a cavity to receive the reinforcement inserts.

Preferably, the composite table top further comprises a longitudinal beam or a transversal beam.

Preferably, the top surface of the projections is glued to the inner surface of the top plate.

Preferably, the bottom plate has an upward flange on the outer peripheral edges, wherein the upward flange includes an upward sloped surface, and a substantially vertical surface extending from the upward sloped surface, wherein the reinforcement inserts have a corresponding upper support surface abutting the downward sloped surface, and a corresponding lower support surface supporting the upward sloped surface.

Preferably, the projections are spaced at an equal distance.

Preferably, bases of the projections are adjacent.

BRIEF DESCRIPTION OF THE DRAWINGS

These and other features of the invention will become more apparent from the following description in which reference is made to the appended drawings wherein.

DETAILED DESCRIPTION

First Embodiment

Figure 1:
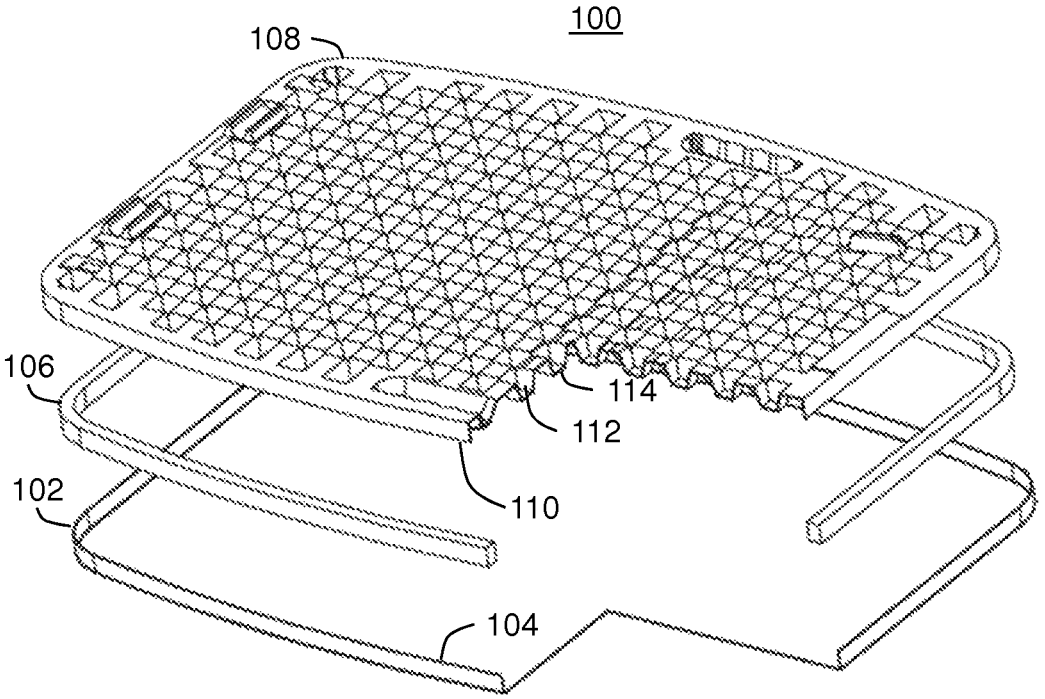
FIG. 1 shows an exploded view and a partially sectional view of a first embodiment in accordance with the present invention.

FIG. 1 shows an exploded view with a partially sectional view of a first embodiment in accordance with the present invention. The composite table top 100 may be formed by vacuum forming. The composite table top 100 comprises a face plate 102, a reinforcement plate 108 and a reinforcement frame 106. The face plate 102 is generally a flat plate with an upward flange 104 on the outer peripheral edges. The reinforcement plate 108 having the downward flange 110 has a matching shape and corresponding outer peripheral edges to the face plate 102.

Projections 112 are arranged in a rectangular array, or a matrix, on the upper surface of the reinforcement plate 108. The projections 112 in FIG. 1 generally have a shape of a trapezoidal prism.

Figure 2:
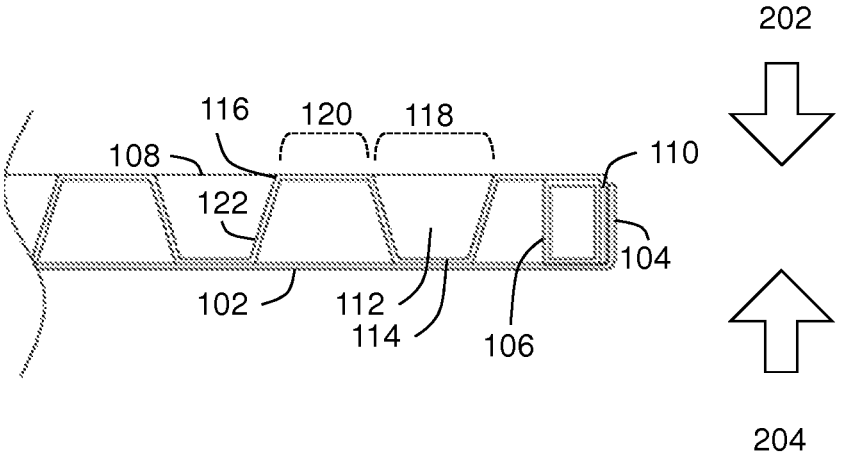
FIG. 2 shows a cross sectional view of the first embodiment in accordance with the present invention.

Referring to FIG. 2, the base of the projections 112 intersects with the surface of the reinforcement plate 108 at a base point 116. The base 118 of the projections 112 forms an opening of a concave pit on the surface of the reinforcement plate 108. The distance between the base openings 118 of the projections 112 is depicted as 120 in FIG. 2. If the distance 120 between the bases is zero, the projections 112 are in an adjacent relationship.

The trapezoidal prism has four sidewalls 122, which taper towards the top surface 114 of the trapezoidal prism. In the embodiment illustrated in FIG. 1, the four sidewalls of the trapezoidal prism have the same size. The projections 112 therefore have a shape of an isosceles trapezoidal prism. The projections 112 may be arranged in rows and columns Each of the projections 112 in a row may be aligned with other projections 112 in other rows, or may be offset in relation to the other projections 112. The top surfaces 114 of the projections 112 are bonded to the inner surface of face plate 102, for example through ultrasonic welding. The sum of the top surfaces 114 of the projections 112 is a fraction of the total inner surface of the face plate 102. Preferably, the sum of the surfaces of the projections 112 is about 30%-70% of the upper surface of the reinforcement plate 108. More preferably, the sum of the surfaces of the projections 112 is about 40%-60% of the upper surface of the reinforcement plate 108.

In one embodiment, each of the top surface 114 of the projections 112 has a size of 1 to 15 $cm^2$.

It should be apparent to a person skilled in the art that not all projections 112 on the upper surface of the reinforcement plate 108 need to be bonded to the inner surface of the face plate 102. For example but not limited to, bonding of alternate top surfaces 114 of the projections 112 may be sufficient. Pipes with a square cross section may be used to form the reinforcement frame 106 that is between the face plate 102 and the reinforcement plate 108. Every projection 112 forms a concave pit in the lower surface of the reinforcement plate 108.

FIG. 2 provides a cross-sectional view of the reinforcement plate 108 with the projection 112, the face plate 102 and the reinforcement frame 106. The reinforcement plate 108 bonds the face plate 102 through projection 112. The downward flange 110 of the reinforcement plate 108 meets the upward flange 104 of the face plate 102 vertically to form the outboard of the whole table top. The reinforcement frame 106 supports the table top.

In this disclosure, the term "projection" is mostly used. However, it should be apparent to a person skilled in the art that the term "projection" is from the direction of the face plate 102, as indicated by the arrow 204 in FIG. 2. When viewed from the other direction, as indicated by the arrow 202, the projections can also be considered as indentation formed by the opening of a concave pit on the surface of the reinforcement plate 108. In this disclosure the term "projection" and the term "indentation" may be used, depending on the viewing direction.

Second Embodiment

Figure 3:
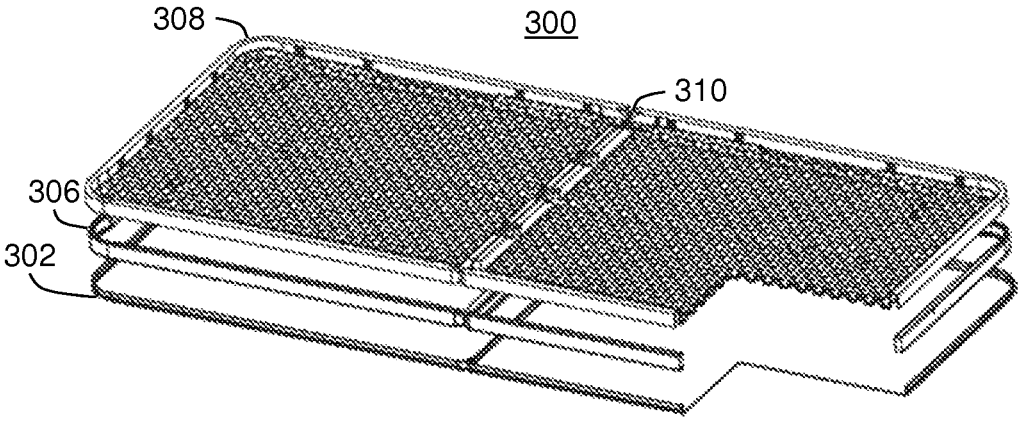
FIG. 3 illustrates an exploded view and a partially sectional view of a second embodiment in accordance with the present invention.

FIG. 3 shows an exploded view with a partially sectional view of a second embodiment in accordance with the present invention. The basic interior structure of the composite table top 300 is similar to the first embodiment such that it comprises a face plate 302, a reinforcement plate 308 and a reinforcement frame 306. The difference is that the composite table top 300 is made of two pieces, and connected through a hinge 310. The composite table top 300 can be folded facing the lower surface of the reinforcement plate 308 through the hinge 310.

Third Embodiment

Figure 4:
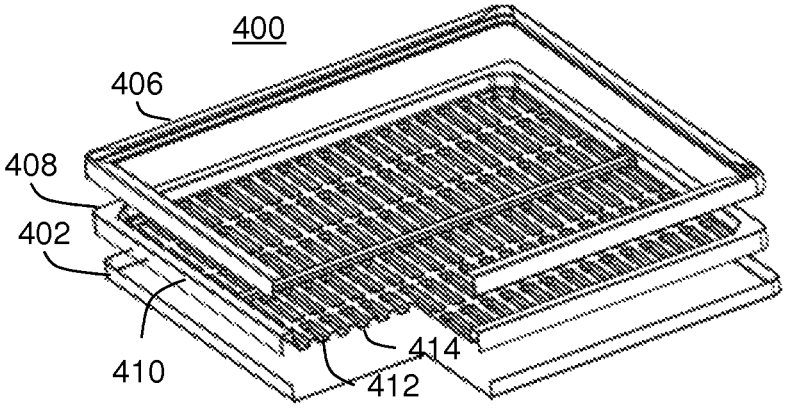
FIG. 4 is an exploded view and a partially sectional view of a third embodiment in accordance with the present invention.

FIG. 4 shows an exploded view with a partially sectional view of a third embodiment in accordance with the invention. The composite table top 400 comprises a face plate 402 that has the same structure as the first and second embodiments, a reinforcement plate 408 and a reinforcement frame 406. The projections 412 of the reinforcement plate 408 are long trapezoidal prisms and distributed as an array in rows and columns Each of the projections 412 forms a concave pit lower surface of the reinforcement plate 408. The top surface 414 of the projection 412 which is in contact with the inner surface of the face plate 402 is also rectangular.

Figure 5:
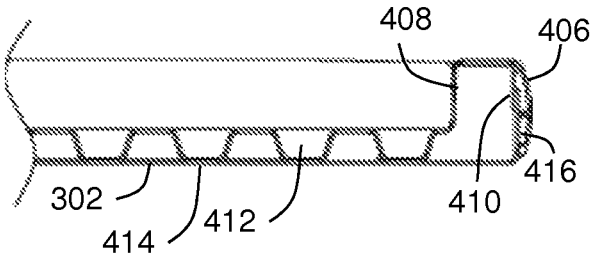
FIG. 5 shows a cross sectional view of the third embodiment in FIG. 4.

FIG. 5 provides a cross-sectional view of the table top 400 including reinforcement plate 408 with the projection 412, the face plate 402 and the reinforcement frame 406. In one example, the projections 412 of the reinforcement plate 408 may be attached to the inner surface of the face plate 402 through glue bond. In this embodiment, the reinforcement frame 406 has an L-shaped cross-section and is adapted to cover the periphery of the reinforcement plate 408 and the upward flange 416 of the face plate 402. In other words, the reinforcement frame 406 is on the exterior side of the reinforcement plate 408. The reinforcement frame 406 covers the upward flange 416 and downward flange 410 which are engaged with each other.

Fourth Embodiment

Figure 6:
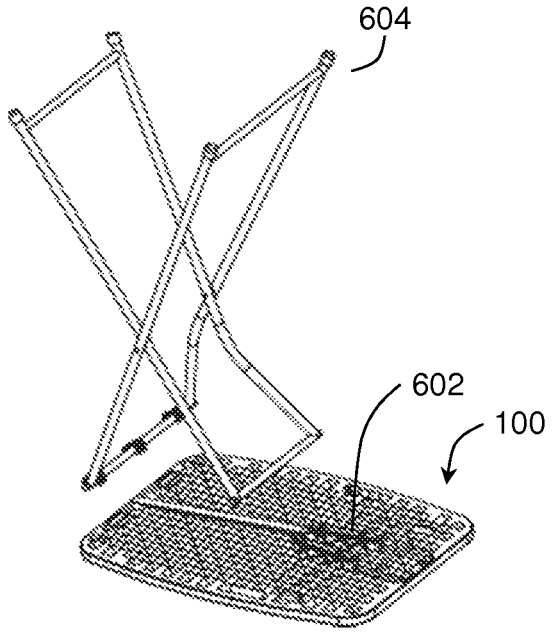
FIG. 6 is a perspective view of a fourth embodiment in accordance with the present invention.

FIG. 6 shows a perspective view of a fourth embodiment in accordance with the invention. The composite table top 100 used in this embodiment is the same as the first embodiment. A portable folding scheme is formed by fastening mechanism 602 located on the bottom of the composite table top 100 and used for fastening the folding legs 604.

Fifth Embodiment

Figure 7:
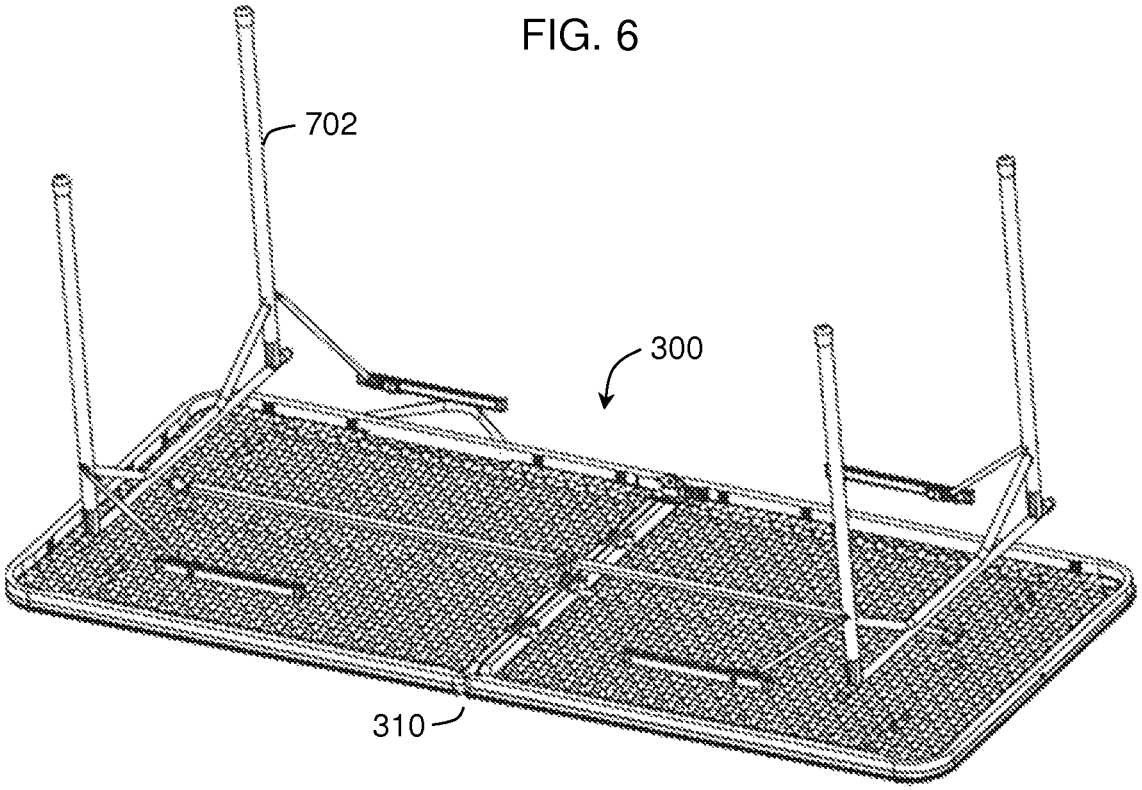
FIG. 7 shows a perspective view of a fifth embodiment in accordance with the present invention.

FIG. 7 shows a perspective view of a fifth embodiment in accordance with the invention. This embodiment shares the same composite table top 300 and the hinge 310 of the second embodiment and has folding legs 702 attaching to an exterior side frame of composite table top 300. After sequentially folding the legs 702 and the composite table top 300, the table occupies very little storage space.

Sixth Embodiment

Figure 8:
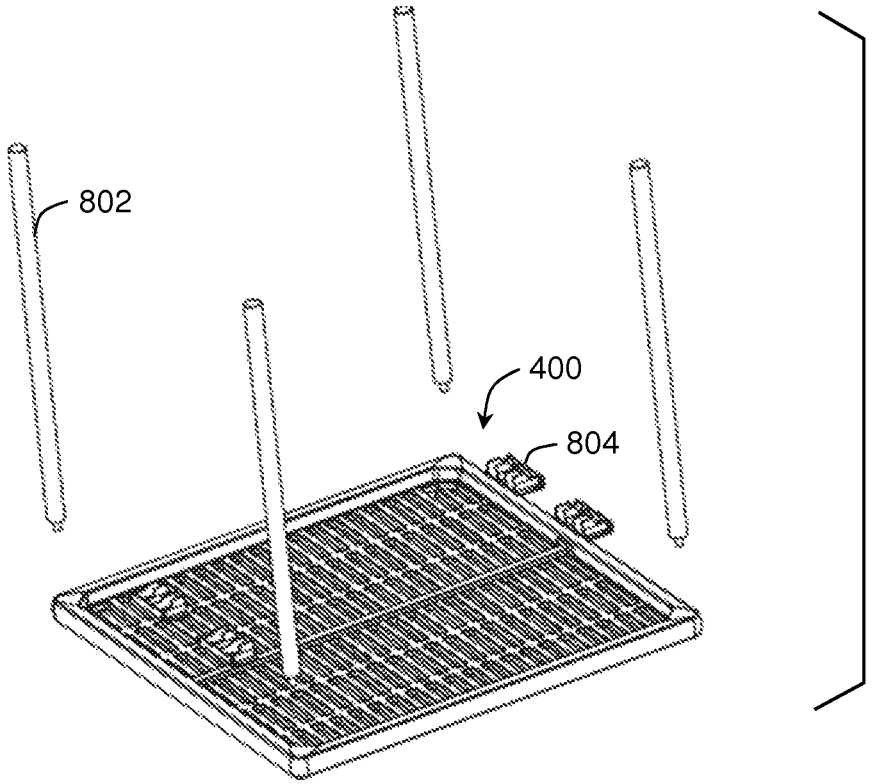
FIG. 8 is a perspective view of a sixth embodiment in accordance with the present invention.

FIG. 8 shows a perspective view of a sixth embodiment in accordance with the invention. This embodiment shares the same composite table top 400 with the third embodiment. The table has four detachable legs 802 which are inserted in the four corners of the bottom of the composite table top 400. A holder 804 is located on the bottom of the composite table top 400 and is used for holding the detachable legs 802 when the table is transported or stored.

Seventh Embodiment

Figure 9:
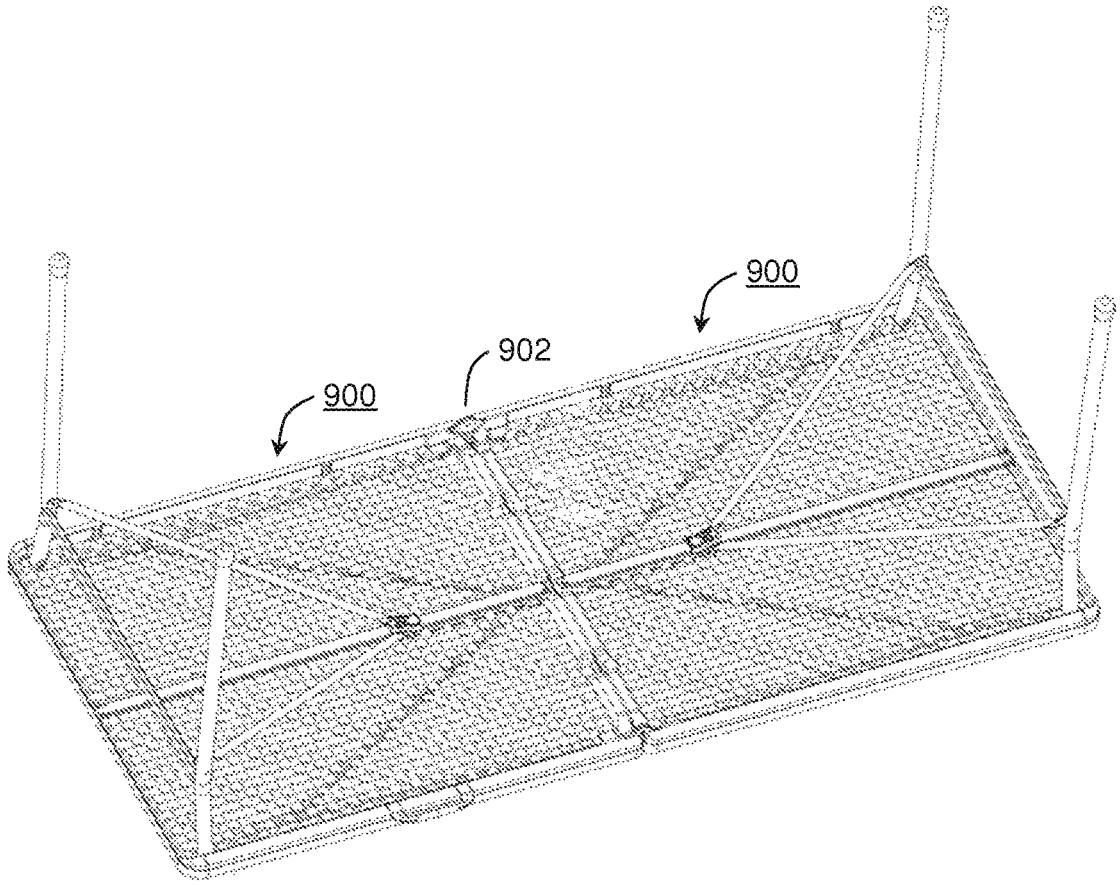
FIG. 9 shows a perspective view of a seventh embodiment in accordance with the present invention.

Referring to FIG. 9, a folding table in accordance with a seventh embodiment of the present invention is shown in an upside down position. The table comprises two table tops 900 which are connected to each other through a hinged connection 902. It should be apparent to a person skilled in the art that the table tops 900 may be used for other purposes.

Figure 10:
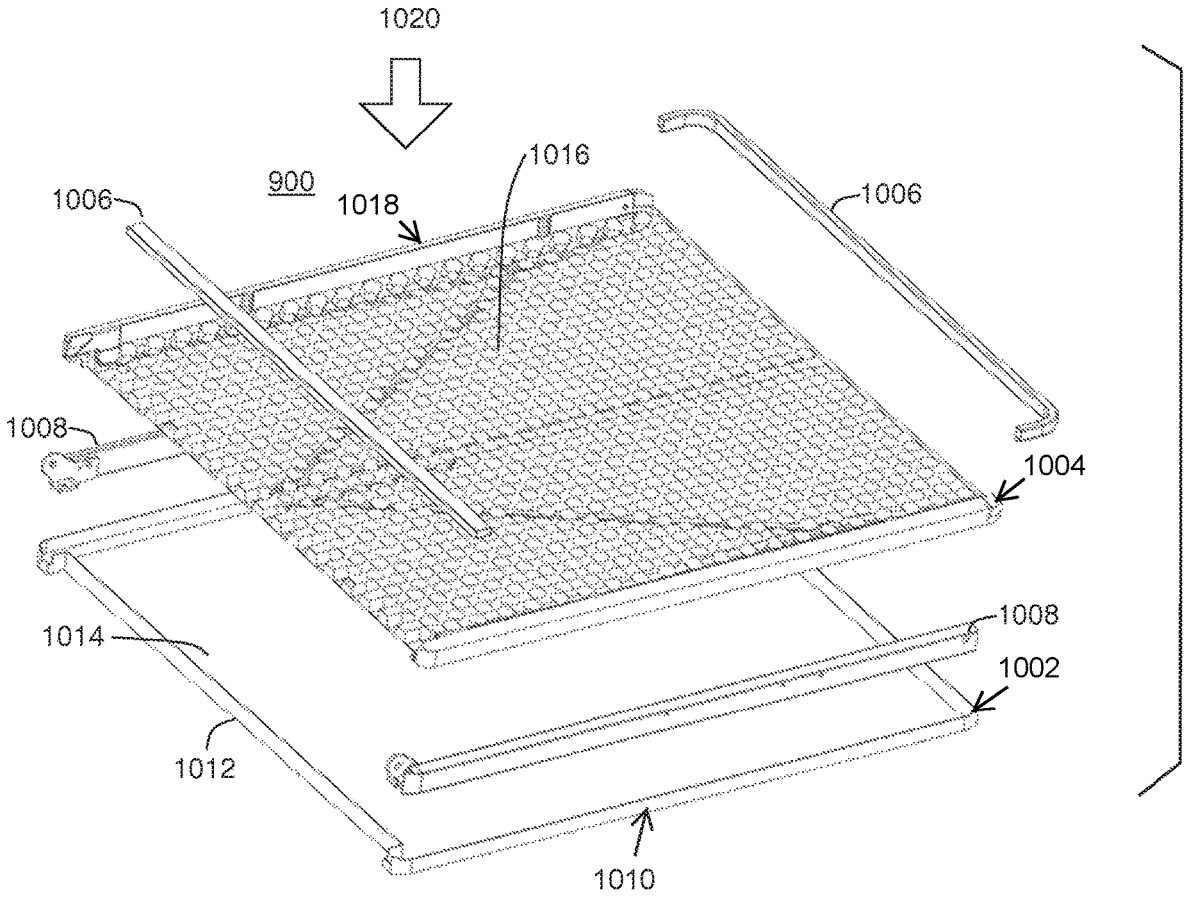
FIG. 10 shows an exploded view of the table top of the seventh embodiment.
Figure 11:
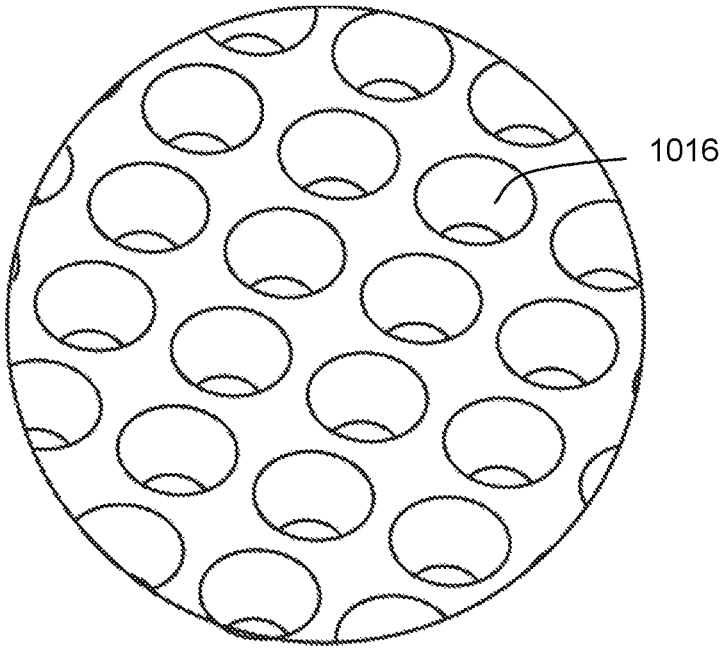
FIG. 11 shows an enlarged view of an area shown in FIG. 10.

Referring to FIG. 10, the table top 900 comprises: a top face plate 1002, a bottom plate 1004, a first pair of reinforcement inserts 1006 and a second pair of reinforcement inserts 1008.

The top face plate 1002 may be formed by blow molding process or other suitable processes known to a person skilled in the art. The top face plate 1002 has an inner surface 1014 and an outer surface 1012. The top face plate 1002 may further have a downward flange 1010.

Figure 13:
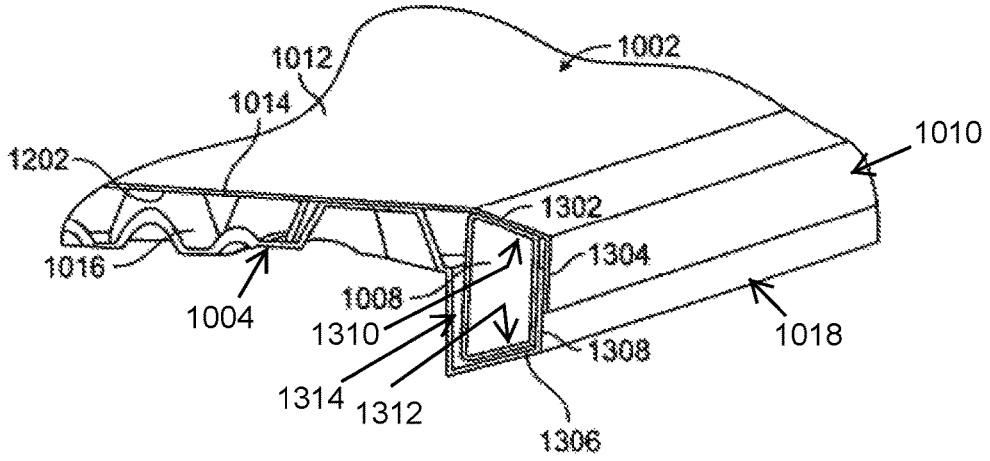
FIG. 13 shows another cross-sectional view of the table top of the seventh embodiment.

Referring to FIG. 13, the downward flange 1010 includes a downward sloped surface 1302 and a substantially vertical surface 1304.

Now referring to FIGS. 10-13, the bottom plate 1004 is generally manufactured through a vacuum forming process. Vacuum forming is a kind of thermoforming, whereby a sheet of plastic is heated to a forming temperature, stretched onto or into a single-surface mold, and held against the mold by applying a vacuum between the mold surface and the sheet. The vacuum forming process is more efficient than blow molding process, generally by a factor of 3-5 folds. The bottom plate 1004 may also be manufactured through other processes.

The bottom plate 1004 comprises a plurality of projections 1016, when viewed from the direction as indicated by arrow 1020. When viewed from the opposite direction, the same formations could be considered as projections.

The projections 1016 may be aligned in rows, in columns or both. The projections 1016 may be offset. The term "offset" is used to describe an alignment of the projections 1016 when the projections 1016 are aligned in a direction but not in a perpendicular direction. The projections 1016 bottom plate 1004 may be formed by, for example but not limited to, the vacuum forming process. Other processes, for example, injection molding, may also be used.

Figure 12:
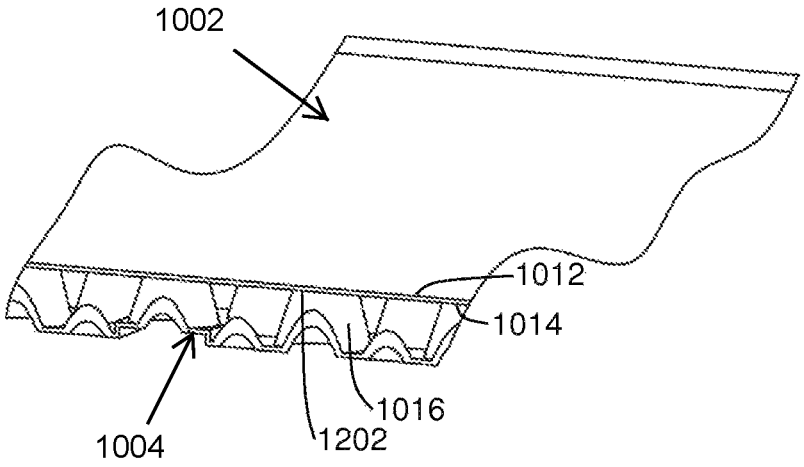
FIG. 12 shows a cross-sectional view of the table top of the seventh embodiment.

Referring to FIG. 12, the top 1202 and the sidewall of the projection 1016 can distribute the pressure coming from the top face plate 1002. The projection 1016 may be cylindrical, conical, trapezoidal prism or other forms. In the preferred seventh embodiment, the projection 1016 has a conical shape, and the top 1202 of the projection 1016 is therefore flat.

The sum of the surfaces the projection tops 1202 is a fraction of the total surface of the bottom plate 1004. Preferably, the sum of the surfaces of the tops 1202 is about 30%-70% of the total surface of the bottom plate 1004. In one embodiment, each of the tops 1202 of the projections 1016 has a size of 1 to 15 $cm^2$. Preferably, the height of the projections 1016 is between 0.5 and 20 mm.

Referring to FIG. 13, the bottom plate 1004 has an upward flange 1018 on the outer peripheral edges. The upward flange 1018 includes an upward sloped surface 1306, and a substantially vertical surface 1308 which extends from the upward sloped surface 1306. The reinforcement inserts 1008 have a corresponding upper support surface 1310 abutting the downward sloped surface 1302, and a corresponding lower support surface 1312 supporting the upward sloped surface 1306. The reinforcement inserts 1006 may have similar arrangement.

FIG. 10 shows the first pair of reinforcement inserts 1006 embedded in the left side and the right side of the table top 900. The second pair of reinforcement inserts 1008 are embedded in the front and the back side of the table top 900. Both the first pair of reinforcement inserts 1006 and the second pair of reinforcement inserts 1008 reinforce the table top 900 and may be used for connecting table legs. In one embodiment, the first pair of reinforcement inserts 1006 and the second pair of reinforcement inserts 1008 are separate. In another embodiment, the first pair of reinforcement inserts 1006 and the second pair of reinforcement inserts 1008 are joined together to form a reinforcement frame.

Now referring to FIGS. 10, 12 and 13, the top 1202 of the projection 1016 abuts the inner surface 1014 of the top face plate 1002. The top 1202 may be glued to the inner surface 1014. The downward flange 1010 of the top face plate 1002 and the upward flange 1018 of the bottom plate 1004 form a cavity 1314 to receive the reinforcement inserts 1008. The reinforcement inserts 1006, 1008 are surrounded by top face plate 1002 and the bottom plate 1004. The upper support surface 1310 abuts the downward sloped surface 1302. The lower support surface 1312 abuts the upward sloped surface 1306. The downward flange 1010 joins the upward flange 1018 by joining the vertical surfaces 1304 and 1308.

Ninth Embodiment

Figure 14:
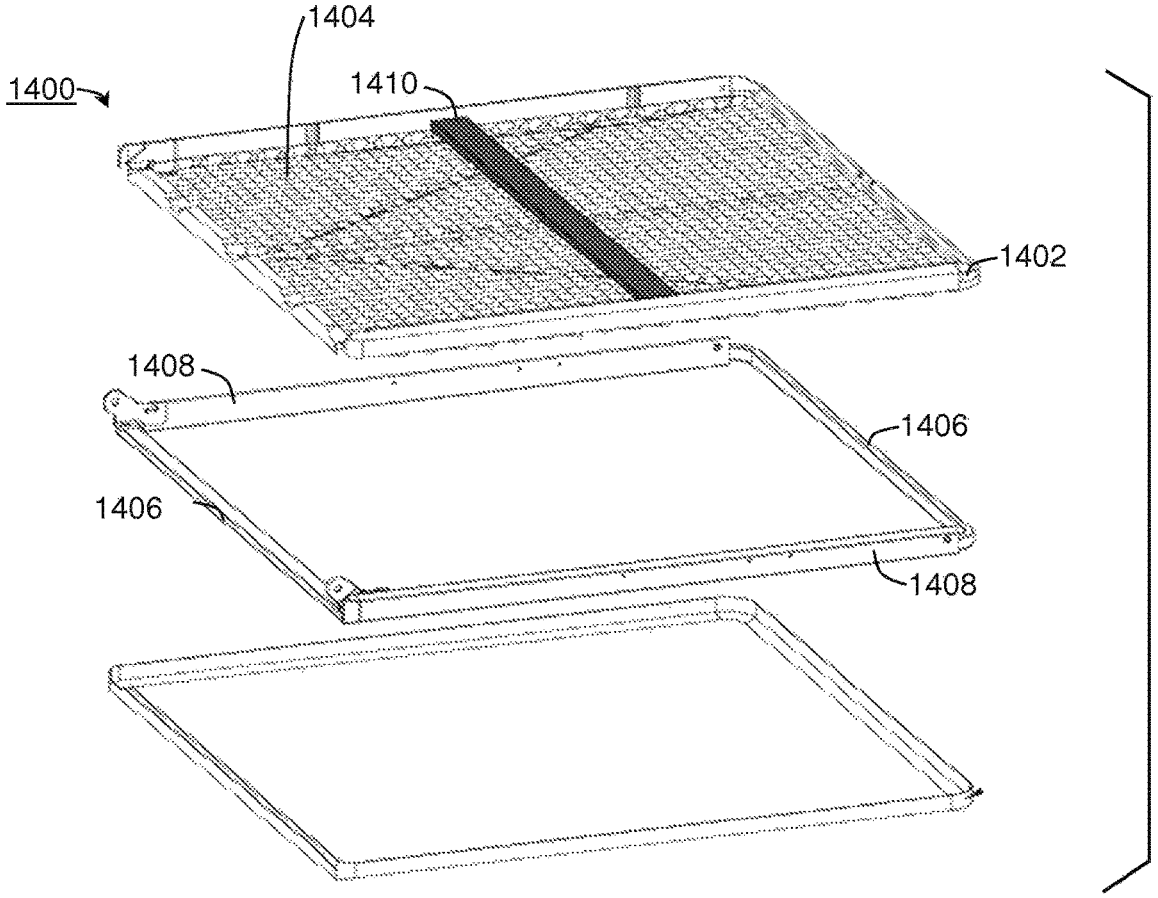
FIG. 14 shows an exploded view of the table top of an eighth embodiment.

FIG. 14 shows a perspective view of a ninth embodiment in accordance with the invention. The bottom plate 1402 comprises a plurality of projections 1404. Each of the plurality of projections 1404 has a top. Preferably, the sum of the surfaces of the tops is about 40%-60% of the total surface of the bottom plate 1402. In one embodiment, each of the tops of the projections 1404 has a size of 3 to 9 $cm^2$. The reinforcement inserts 1406, 1408 form a unitary metal frame. The table top 1400 may further include a beam 1410. The beam 1410 contributes further to the strength of the table top 1400, in particular for large size table tops. The beam may be provided in the longitudinal or transversal direction.

Advantageously, the bottom plate of the present invention has a plurality of projections. The projections may be arranged in matrix or in rows which are offset. The tops of the projections abut the inner surface of the top face plate. The tops and the sidewalls of the projections can distribute the pressure coming from the top face plate, improving the top plate's ability to withstand the pressure stress. Therefore, the thickness of the top plate can be reduced.

Advantageously, the reinforcement inserts are embedded around the edges of the table top, for increasing the strength of the periphery of the table top. The reinforcement inserts may be made of metal, and may be used for connecting the table legs.

Advantageously, the reinforcement inserts may be unitary to form a frame, further increasing the strength of the table top.

Advantageously, the sum of the surfaces of the tops of the projections is about 30%-70% of the total surface of the bottom plate. The contact area of the top surfaces reinforces the strength of the table top.

Advantageously, the size of the tops of the projections is about 1 to 15 $cm^2$. Therefore, the relative small size of the top surface allows an increase of the number of the projections, resulting in an increase of the sidewall surface and therefore the strength of the table top.

Advantageously, the shape of the projections may be cylindrical, or conical for better pressure resistance. The height of the projections may range from 0.5 to 20 mm to provide better manufacturability and pressure resistance.

Advantageously, the table top may further include a beam, either transversal or longitudinal, for increasing the strength of the table top.

Advantageously, the bottom plate may be manufactured through a vacuum forming process, to provide an efficient process. The product made by vacuum forming process has less shrinkage and better uniformity.

Advantageously, the top plate may be glued to the bottom plate to increase the stability of the table top.

Advantageously, the sloped surfaces on the peripheries of the top plate and the bottom plate provide better thickness uniformity of the top plate and the bottom plate, reduce the stress on the flanges, and prevent deformation of the table top.

The present invention is not to be limited in scope by the specific embodiments described. Changes and modifications may be made to such embodiments without departing from the true scope of the invention. Indeed, various modifications of the invention in addition to those shown and described herein will become apparent to those skilled in the art from the foregoing description and accompanying drawings. Such modifications are intended to fall within the scope of the appended claims.

The invention claimed is:

1. A table top comprising:

an inner table top section and a perimeter section around a perimeter of the inner table top section, the perimeter section having four sides;

the inner table top section having an inner section of a top plate and an inner section of a bottom reinforcing plate;

the top plate having a top surface and a bottom surface;

the inner section of the bottom reinforcing plate having a plurality of projections, with the bottom surface of the top plate attached to and supported by top surfaces of the projections;

the perimeter section of the table top including a downward flange around outer peripheral edges of the top plate;

the perimeter section of the table top including an upward flange on the bottom reinforcing plate around outer peripheral edges of the bottom reinforcing plate, with the upward flange including a first vertical surface and with the downward flange including a second substantially vertical surface extending down from a downward sloped surface, the second vertical surface partially overlying, parallel to and in contact with the first vertical surface, and with the second vertical surface forming an outermost surface of the table top;

the upward flange and the downward flange in part forming an enclosed cavity around the four sides of the perimeter section;

the top surface of the top plate having a downward inclined portion having an inner end adjoining a flat inner area of the top surface of the top plate, and the inclined portion having an outer end adjoining an upper end of the second vertical surface forming an outermost surface of the table top;

a hollow tubular reinforcement frame inside of the cavity, the hollow tubular reinforcement frame having a first side alongside and parallel to the vertical surface of the upward flange, the hollow tubular reinforcement frame having a second side alongside and parallel to the downward sloped surface of the downward flange, the second side at an obtuse angle to the first side, the hollow tubular reinforcement frame having a third side parallel to the first side and at an acute angle to the second side, and with the third side longer than the first side; and first and second pairs of folding leg assemblies at opposite ends of the table top, with each folding leg assembly pivotally attached to the hollow tubular reinforcement frame.

2. The table top of claim 1 wherein the projections are vacuum-formed.

3. The table top of claim 1 further including first and second hinges on adjacent corners of the hollow tubular reinforcement frame.

4. A table top comprising:

a top plate (1002) having a flat top surface (1012), a downward sloped surface (1302) adjoining the flat top surface (1012) at a perimeter of the top plate, and a downward flange (1010) adjoining the downward sloped surface (1302);

a bottom plate (1004) having an inner section joined to an outer section, the inner section including a plurality of projections, with a bottom surface of the top plate attached to the projections, the outer section having an upward sloped surface (1308) and an upward flange (1018) joined to the upward sloped surface, the downward flange (1010) parallel to and overlying the upward flange (1018), the downward flange (1010) perpendicular to the flat top surface (1012);

the downward sloped surface (1302), the upward sloped surface (1306), and at least one of the downward flange (1010) and the upward flange (1018), forming a trapezoid-shaped cavity (1314);

a tubular reinforcement (1008) in the cavity (1314), the tubular reinforcement having a trapezoid-shape cross section including first and second non-parallel sides, the downward flange overlying the first side and the upward flange overlying the second side.

* * * * *